United States Patent [19]

Futami et al.

[11] 4,407,019

[45] Sep. 27, 1983

[54] ELECTRONIC WRISTWATCH

[75] Inventors: Yoshinori Futami; Tokumon Ogawa, both of Suwa, Japan

[73] Assignee: Kabushiki Kaisha Suwa Seikosha, Tokyo, Japan

[21] Appl. No.: 235,787

[22] Filed: Feb. 19, 1981

Related U.S. Application Data

[63] Continuation-in-part of Ser. No. 927,250, Jul. 21, 1978.

[30] Foreign Application Priority Data

Jul. 21, 1977 [JP] Japan ..... 52-87724

[51] Int. Cl.[3] ..... G04B 17/12

[52] U.S. Cl. ..... 368/200; 368/186

[58] Field of Search ..... 368/200, 201, 202, 184, 368/186, 189

[56] References Cited

U.S. PATENT DOCUMENTS

| | | | |
|---|---|---|---|
| 3,777,471 | 12/1973 | Koehler et al. . | |
| 3,895,486 | 7/1975 | Hammer et al. . | |
| 3,916,612 | 11/1975 | Morokawa et al. . | |
| 4,051,663 | 10/1977 | Chihara et al. | 368/200 |
| 4,075,827 | 2/1978 | Yoshida et al. . | |
| 4,085,577 | 4/1978 | Natori | 368/201 |
| 4,148,184 | 4/1979 | Akahane et al. | 368/201 |
| 4,155,218 | 5/1979 | Wiget | 368/201 |
| 4,254,494 | 3/1981 | Maeda | 368/200 |
| 4,290,130 | 9/1981 | Lowdenslager et al. | 368/200 |
| 4,292,680 | 9/1981 | Morokawa et al. | 368/200 |

*Primary Examiner*—J. V. Truhe
*Assistant Examiner*—Forester W. Isen
*Attorney, Agent, or Firm*—Blum, Kaplan, Friedman, Silberman & Beran

[57] ABSTRACT

An electronic wristwatch wherein a timing rate adjustment signal, representative of the amount of timing rate adjustment being effected and/or needed to be effected, is depicted. The electronic wristwatch includes a divider circuit for receiving a high frequency time standard signal from a quartz crystal oscillator circuit and for producing a low frequency timekeeping signal in response thereto. An adjustment circuit is coupled to the divider circuit for adjusting the frequency of the timekeeping signal by a predetermined amount. A converter circuit is adapted to be selectively coupled to the divider circuit to receive the adjusted low frequency timekeeping signal and, in response thereto, to produce a timing rate adjustment signal representative of the amount of adjustment applied in the low frequency timekeeping signal, and to produce a signal representative of the unadjusted oscillator frequency.

16 Claims, 8 Drawing Figures

C4
C3
C2
C1
C0
T
Bf
Fn1
Fn5
Ro1
Ro2
D
Fmo
Fm
Fb
Ff

ELECTRONIC WRISTWATCH

BACKGROUND OF THE INVENTION

This application is a continuation-in-part of application Ser. No. 927,250 filed July 21, 1978, for Electronic Timepiece.

This invention is directed to a miniature electronic timepiece and, in particular, to a quartz crystal electronic wristwatch capable of providing a timing rate adjustment signal representative of the amount of timing rate adjustment being effected and/or needed to be effected in order to obtain accurate timekeeping.

Heretofore, several methods have been utilized for adjusting the timing rate of an electronic wristwatch in order to obtain improved accuracy. Initially, oscillator circuits were provided with tuning capacitors and other variable impedance elements for permitting the high frequency signal produced thereby to be selectively varied. Thereafter, it was found that more accurate adjustment of the timing rate of the timekeeping circuit could be effected by utilizing an adjustment circuit to continuously apply an adjustment signal to the divider circuit. By this approach, the frequency of the signal, produced by the oscillator circuit, would not be varied. Still further approaches have included the use of at least two high frequency vibrators and a comparator for comparing the frequencies thereof and producing an error signal. Although each of these methods have permitted highly accurate adjustment of the timing rate of the low frequency timekeeping signal without occupying a considerable amount of space, due to increasing current consumption, or substantially increasing the cost of manufacture, such methods have been found to be less than completely satisfactory. Specifically, by using the methods noted above, it is difficult to measure the accuracy of the timing rate and, additionally, it takes a considerable period of time to obtain this type of measurement since the amount of time required for the adjustment signal to be applied to the divider circuit must be taken into account in any measurement that is made.

SUMMARY OF THE INVENTION

Generally speaking, in accordance with the instant invention, an electronic wristwatch wherein a timing rate adjustment signal, representative of the amount of frequency adjustment of at least the divider circuit, is provided. The electronic wristwatch includes an oscillator circuit producing a high frequency time standard signal. A divider circuit is provided for receiving the high frequency time standard signal and for producing a low frequency timekeeping signal in response thereto. An analog or digital display is provided for receiving the low frequency timekeeping signal and producing an indication of actual time in response thereto. An adjustment circuit is coupled to the divider circuit for effecting a predetermined accuracy adjustment which is included in the frequency of the low frequency timekeeping signal produced thereby. A converter circuit is adapted to selectively receive the output low frequency timekeeping signal, operate on the timekeeping signal and thereby produce a timing rate adjustment signal representative of the amount of adjustment which is normally included in the frequency of the low frequency timekeeping signal effected by said adjustment circuit, and a signal representative of the oscillator frequency is also produced.

Accordingly, it is an object of the instant invention to provide an electronic wristwatch circuit for providing highly accurate adjustment of the timing rate thereof.

A further object of the instant invention is to provide an electronic wristwatch capable of producing a timing rate adjustment signal for permitting a determination in a short time of the amount of needed adjustment of the timing rate.

Still a further object of the instant invention is to provide a converter circuit for selectively receiving a low frequency timekeeping signal and producing a signal representative of the adjustment included therein in normal timekeeping.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
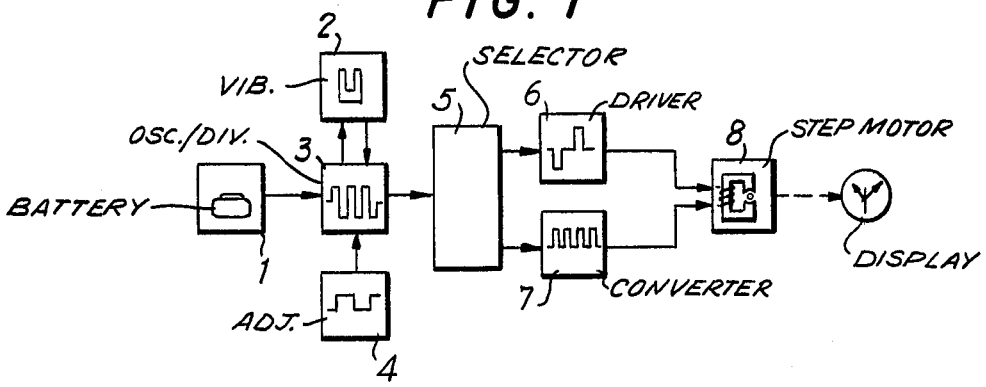
FIG. 1 is a block circuit diagram of an electronic wristwatch circuit constructed in accordance with a preferred embodiment of the instant invention.

Reference is first made to FIG. 1, wherein an electronic wristwatch, constructed in accordance with a preferred embodiment of the instant invention, is depicted. The wristwatch includes a DC battery for energizing the timekeeping circuit of the wristwatch in a conventional manner. Battery 1 is coupled to an electronic oscillator/divider circuit 3. The oscillator circuit is coupled to a quartz crystal vibrator 2, which vibrator is adapted to vibrate at frequencies on the order of $2^{16}$ Hz and thereby cause the oscillator circuit to produce a high frequency time standard signal. The divider circuit is comprised of a plurality of series-connected divider stages, which divider stages receive the high frequency time standard signals from the oscillator circuit and divide the high frequency time standard signals down into a low frequency timekeeping signal. The timing rate of output from the divider circuit 3 is controlled by an adjustment circuit 4, which circuit is adapted to vary the frequency of the low frequency timekeeping signal produced by the divider circuit by applying thereto a frequency adjustment signal once during each predetermined interval of time when adjustment for accuracy of the timing rate is needed. For example, an adjustment signal may be applied in the divider circuit, as one pulse during each ten second period. The converter 7 provides a signal of an interval, e.g. 0.010 seconds, which interval signal can be used in determining the amount of adjustment being made.

The low frequency timekeeping signal, produced by the divider circuit, is applied to a selector circuit 5, which circuit is normally disposed in a first timekeeping mode to thereby transmit the low frequency timekeeping signal to a driver circuit 6. The driver circuit 6 shapes the low frequency timekeeping signal and applies the shaped signal to a step motor 8. Coupled to the step motor 8 is a clock hand time display 9 that is operated in response to the incremental rotary motion of the step motor resulting from the signals produced by the driver circuit 6. In this condition, accuracy of timekeeping can only be measured by monitoring the periods of the motor driving signals.

When selector circuit 5 is in a second, i.e., time rate adjustment measuring mode, the low frequency timekeeping signal produced by the divider circuit 3 is applied to a converter circuit 7, which circuit is adapted to cyclically produce a periodic signal having a first component representative of the period, after division, of the high frequency time standard signal produced by the oscillator circuit, without adjustment. The converter circuit 7 also produces a modulated signal component that permits the amount of adjustment applied in the divider circuit to be readily calculated.

The modulated signal indicates an amount of time that the adjustment signal, produced by the adjustment circuit, has added to the frequency signal produced in the divider circuit. Thereby the converter circuit can produce a timing rate adjustment signal representative of the pulse interval required to effect such adjustment. Thus, as in the example noted above, for an adjustment signal that is applied once every ten seconds, the modulated signal component will have a pulse with a 10 ms interval that can readily be applied to the proper frequency rate adjustment detection circuit to facilitate determination of the amount of frequency rate adjustment.

In operation, when the selector circuit is disposed in a first timekeeping mode, the adjusted low frequency timekeeping signal is applied to the driver circuit 6, which driver produces an output drive signal that is applied to the step motor 8. It is noted that in the event that the electronic wristwatch has a digital display, a conventional decoding arrangement can be substituted for the step motor 8. Accordingly, when the selector circuit is in first timekeeping mode, the electronic wristwatch performs a normal timekeeping operation in which the accuracy of the timepiece cannot be rapidly measured from the output drive signal produced by the driver circuit 6.

It is noted, however, that when the selector circuit 5 is disposed in a second timing rate adjustment mode, the converter circuit 7 produces a periodic timing rate adjustment signal having a first component representative of the unadjusted time standard signal produced by the oscillator circuit divided down into a one second or two second interval. The converter 7 also produces a modulated component, corresponding to the predetermined adjustment value needed to adjust the frequency for accuracy in the divider circuit. By separating the timing rate adjustment signal into two components, first, the actual frequency being produced by the oscillator circuit and, second the predetermined amount of timing rate adjustment being effected by the adjustment circuit, the accuracy of the timepiece can readily be determined in a short interval of time utilizing appropriate external calculating circuitry. There are two methods for applying adjustments in the divider stages. Either one pulse is applied for every n seconds which have elapsed, or pulses are applied continuously over a fixed period of time on a regular basis. In order to realize a highly accurate measurement within a short time interval, these predetermined values (n seconds or the fixed period of time) are readily converted into a periodic output signal by the circuit 7 by using the predetermined value or the reciprocal thereof, such as a 1/n second period. Of course, multiples of the predetermined value can also be utilized.

It is noted that a control circuit can be provided in the electronic wristwatch to adjust the time display when the selector circuit is in a timing rate adjustment mode. For example, in a digital display timepiece, the control circuit may be necessary to prevent the digital display from being changed in response to the timing rate adjustment measurement signal being produced by the converter 7. Analog clock hands may be inadvertently rotated at the time that the timing rate adjustment is measured. In cases where the drive output signal, (FIG. 1) normally produced by the driver 6, is applied to a step motor, the inadvertent advancing of the step motor can be prevented by assuring that the timing rate adjustment measuring signals are of the same polarity. Alternatively, the pulse width of the timing rate adjustment measuring signals can be provided with a pulse width on the order of 1 ms to 4 ms which is considerably less than a 5 ms to 15 ms pulse width which is required to drive the step motor.

As is detailed below, with respect to FIG. 4, a manually displaceable operative member, such as a correction stem, can be provided for selectively changing over the selector circuit from a normal timekeeping mode to a timing rate adjustment measuring mode in order to permit the timing rate adjustment measurement to be readily effected when the clock hands of the timepiece are being set by the stem. Moreover, it is noted that each of the electronic circuits, including the oscillator/divider circuit 3, selector circuit 5, adjustment circuit 4, driver circuit 6 and converter circuit 7, can each be formed of C-MOS elements that are readily integrated into a circuit chip in order to miniaturize the size of the electronic wristwatch.

Figure 2:
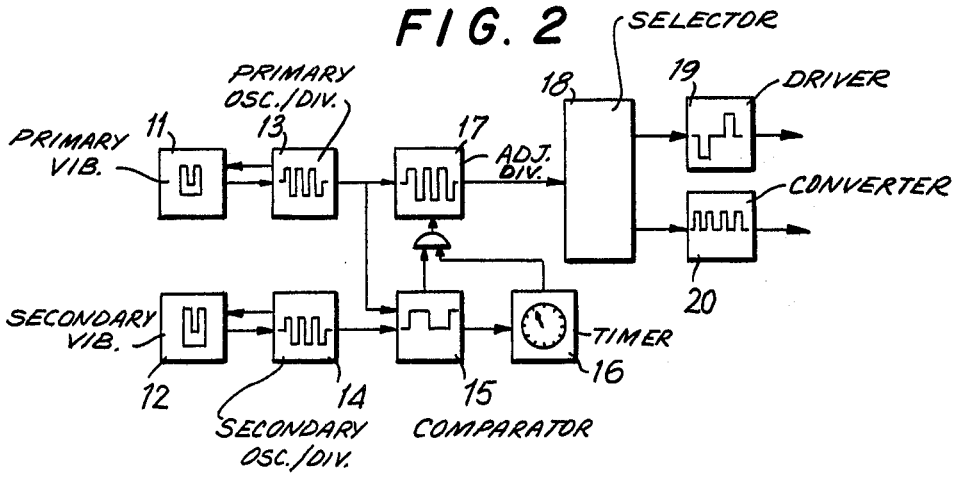
FIG. 2 is a block circuit diagram of an electronic wristwatch circuit constructed in accordance with an alternative embodiment of the instant invention.

Reference is now made to FIG. 2, wherein a further embodiment of an electronic wristwatch having two time standards, is depicted. A primary high frequency quartz crystal vibrator 11 is coupled to a primary oscillator/divider circuit 13. The oscillator circuit produces a high frequency time standard signal in response to the vibration of the primary vibrator 11 and, in response thereto, the divider portion produces a primary intermediate frequency signal. A secondary quartz crystal vibrator 12 is coupled to a secondary oscillator/divider circuit 14, which circuit functions in the same manner as the primary oscillator/divider circuit in order to produce a secondary intermediate frequency signal. The primary intermediate frequency timekeeping signal and the secondary intermediate frequency signal are both applied to a comparator circuit 15, which circuit compares the period of each of the signals applied thereto and produces a difference signal representative of the difference between the respective periods of the primary and secondary intermediate frequency signals. The predetermined difference between the primary and secondary intermediate frequency signals is applied to a timing circuit 16, which circuit, in combination with the comparator 15, applies an adjustment signal over a predetermined time period to an adjustable divider circuit 17. The divider circuit 17 is comprised of additional divider stages for dividing down the primary intermediate frequency signal and producing an adjusted low frequency timekeeping signal which is applied to selector circuit 18. The selector circuit 18 is adapted to be disposed in a first timekeeping mode for transmitting the low frequency timekeeping signal to a driver circuit 19 in order to drive a step motor. When the selector circuit 18 is disposed in a second, that is, timing rate adjustment mode, the converter circuit 20 produces a periodic timing rate adjustment measuring signal that includes the following components that are produced cyclically and in sequence. The first component is a signal having a period representative of the predetermined time period of timer 16 when the adjustment signal is applied to the adjustment circuit 17. The second and third components represent the unadjusted frequencies of the signals produced by the primary quartz crystal vibrator 11 and secondary quartz crystal vibrator 12.

Figure 3:
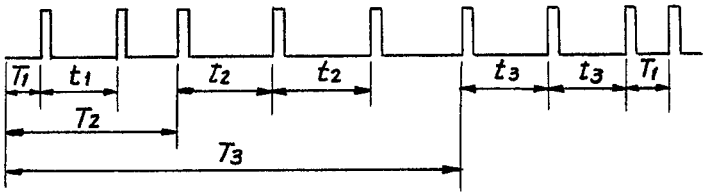
FIG. 3 is a waveform diagram illustrating the operation of the electronic wristwatch circuit depicted in FIG. 2.

An example of a frequency rate adjustment signal of the type produced by the converter circuit 20 is illustrated in FIG. 3. The time intervals $T_1$, $T_2$ and $T_3$ represent selected time intervals. The period $t_1$ is a period representative of the reciprocal of the period timed by the timer 16. Period $t_2$ and period $t_3$ are respectively obtained by dividing the unadjusted high frequency time standard signals down to substantially a one or two second period produced by the primary and second dividers 13,14, respectively and 17. By providing a frequency rate adjustment signal of the type illustrated in FIG. 3, the period of each of the high frequency time standard signals, produced by the respective oscillator circuits, can be measured in addition to the accuracy of the timing rate adjustment effected by the adjustment circuit. This type of measurement facilitates an adjustment of the oscillator circuit in order to obtain greater timing rate accuracy in a wristwatch having two quartz crystal vibrators.

Figure 4:
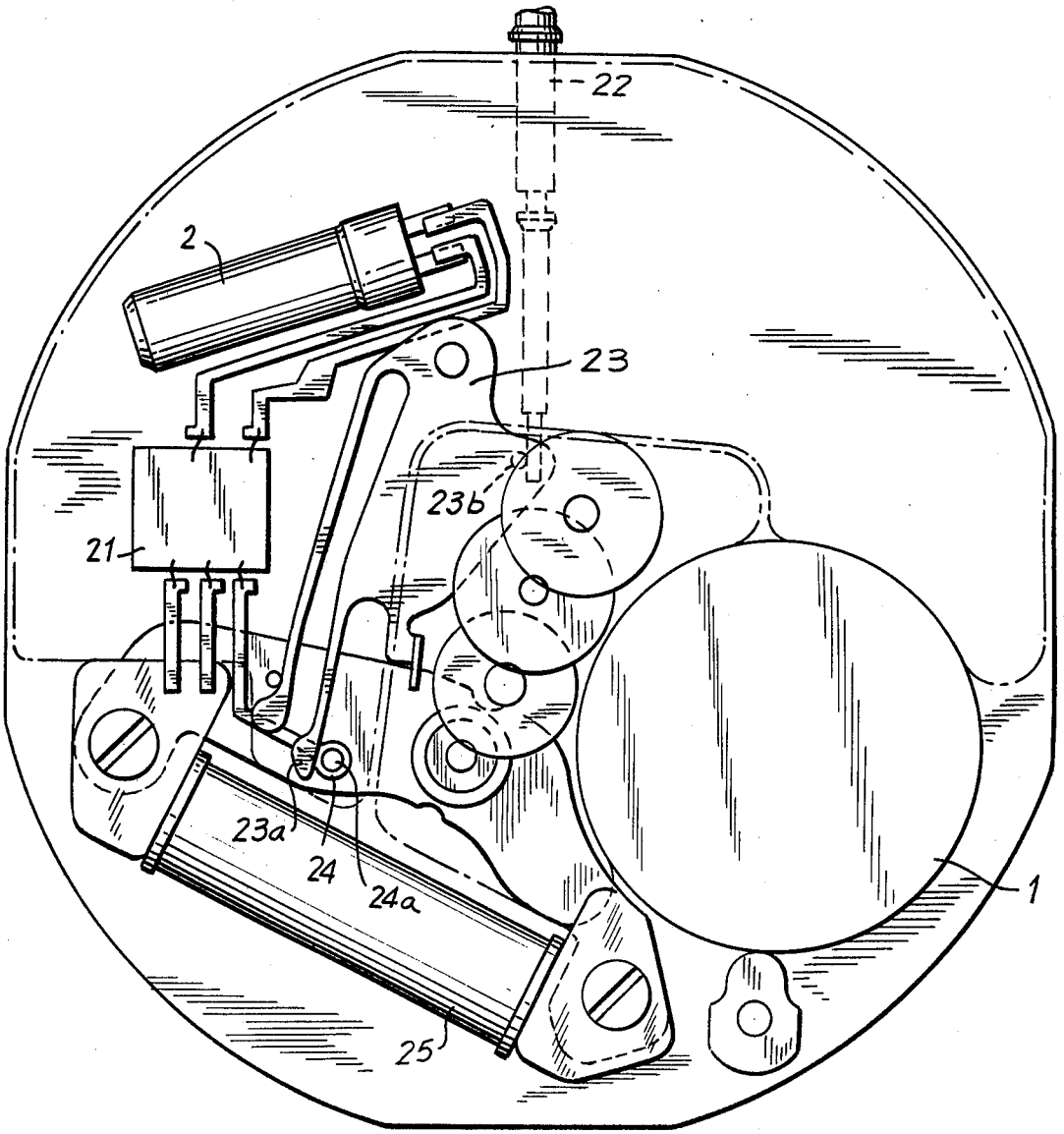
FIG. 4 is a plan view of an electronic wristwatch movement constructed in accordance with the instant invention.

Reference is now made to FIG. 4, wherein a selector circuit control mechanism is depicted, like reference numerals being utilized to denote like elements described above. For example, the battery 1 is coupled through lead 24 to an electronic circuit chip 21, which circuit chip includes the oscillator/divider circuit 3. A quartz crystal vibrator 2 is coupled to the oscillator circuit in the electronic circuit chip 21 in the same manner noted above. Coupled to the electronic circuit chip is the drive coil 25 of a step motor, that operates in a conventional manner.

A manually displaceable stem 22 is normally disposed in the position indicated in FIG. 4, when the wristwatch is in a timekeeping mode. When disposed in an inward position, the tip end of the stem 22 engages a stop pin **23*b* of a resilient switch 23, to thereby displace the moving contact 23*a* of resilient switch 23 to a non-contact position with respect to conductive pin 24*a* of lead 24. When stem 22 is axially displaced away from the center of the wristwatch, the tip thereof clears the stopper pin 23*b* and thereby permits same to rotate the moving contact 23*a* of the resilient switch 23 into electrical contact with the contact pin 24*a* to thereby dispose the selector circuit of the electronic wristwatch into a time rate adjustment mode as a result of the connection of the contact pin 24*a* to the electronic circuit. Thus, when moving contact 23*a* is not in contact with fixed contact 24*a*, the electronic wristwatch is disposed in a timekeeping mode whereby a normal timekeeping operation is provided. However, when moving contact 23*a* is displaced into electrical contact with contact pin 24*a*, the timepiece is disposed in a timing rate adjustment measuring mode whereby the converter circuit is selectively coupled to the divider circuit and thereby produces a frequency rate adjustment measurement signal of the type described above. Also, it is noted that resilient switch 23 can be provided with camming members to regulate the positioning of the gear train when the moving contact 23*a* is displaced into electrical contact with contact pin 24*a***.

Figure 5:
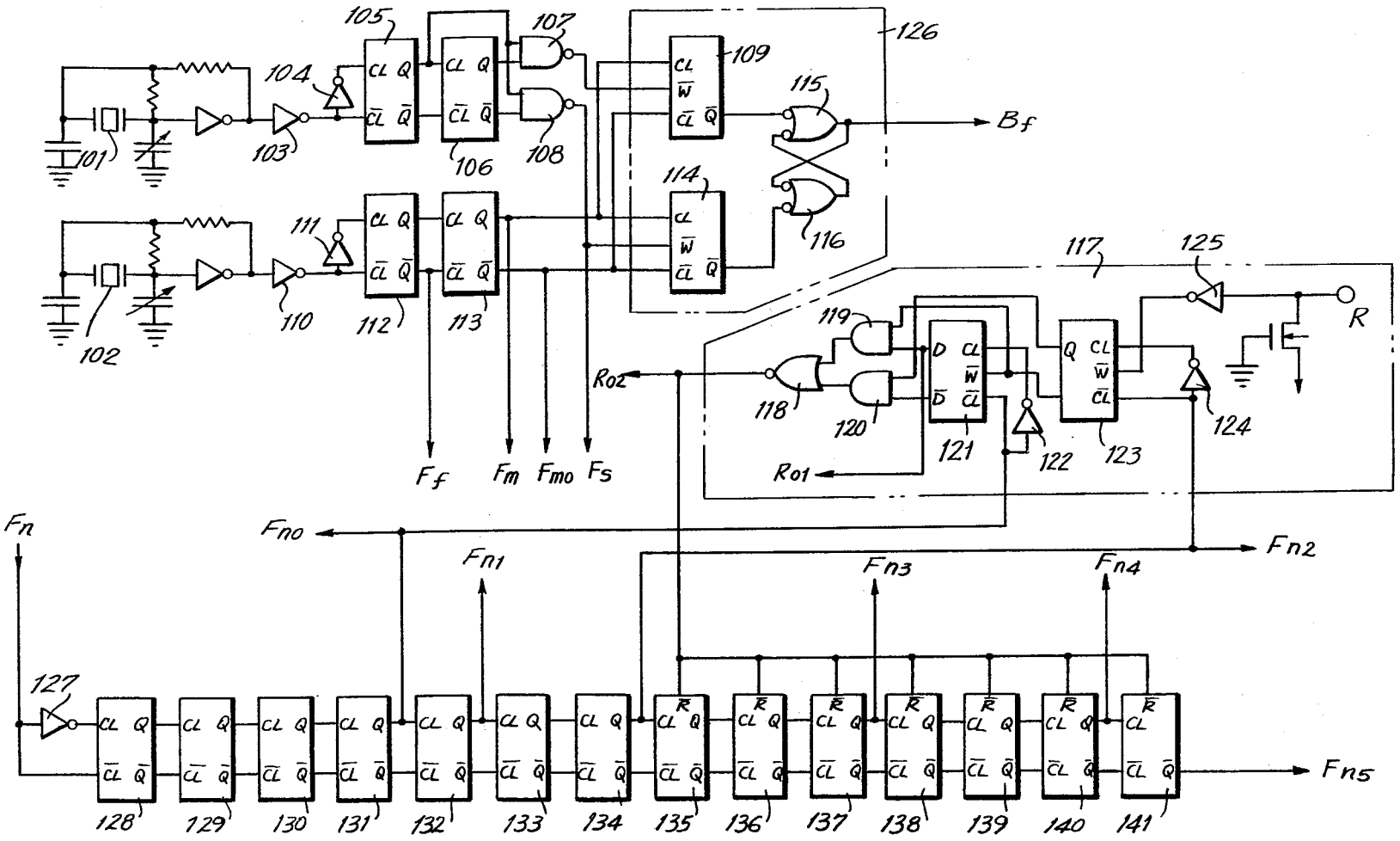
FIGS. 5–7 are detailed schematics of portions of a wristwatch block diagram similar to FIG. 2.

FIG. 5 illustrates a circuit including two oscillators each having an independent vibrator 101, 102 and producing different high frequency time standard signals. This circuit includes a divider network 128–141, a resetting circuit 117 and a frequency difference circuit 126 which outputs a signal indicative of the frequency difference between the two high frequency time standard signals. The frequency difference signal is used in adjusting the periodic timing rate of the timepiece as explained more fully hereinafter.

The time standard vibrators 101, 102 usually oscillate with their associated circuitry at a frequency of substantially 32 KHz. The frequencies generated from these oscillator circuits are divided down in divider circuits 105, 106 and 112, 113 respectively. The signals from the dividers are input to the frequency difference circuit 126 and a frequency difference signal Bf is obtained which is in proportion to the frequency difference which in turn is related to temperature. The frequency difference signal Bf is used for adjusting the timing rate signals from the oscillator 102 to produce accurate timekeeping signals.

A signal Fn is inputted to the divider circuits 128–141 from a source explained hereinafter so as to obtain from different stages of the divider circuits divided signals designated as $Fn_0$, $Fn_1$, $Fn_2$, $Fn_3$, $Fn_4$ and $Fn_5$. When the signal Fn is 8192 hz, the divided signals $Fn_0$–$Fn_5$ have frequencies of 512, 256, 64, 8, 1 and ½ hz, respectively.

In the resetting circuit 117, when an input at R is made high by operating an external member such as a stem, the output $R_{01}$ goes high, and the output $R_{02}$ goes from a high level to a low level and returns to a high level substantially instantaneously. For normal operation, when the external member is not operated, the output $R_{01}$ is low and the output $R_{02}$ is high.

Figure 6:
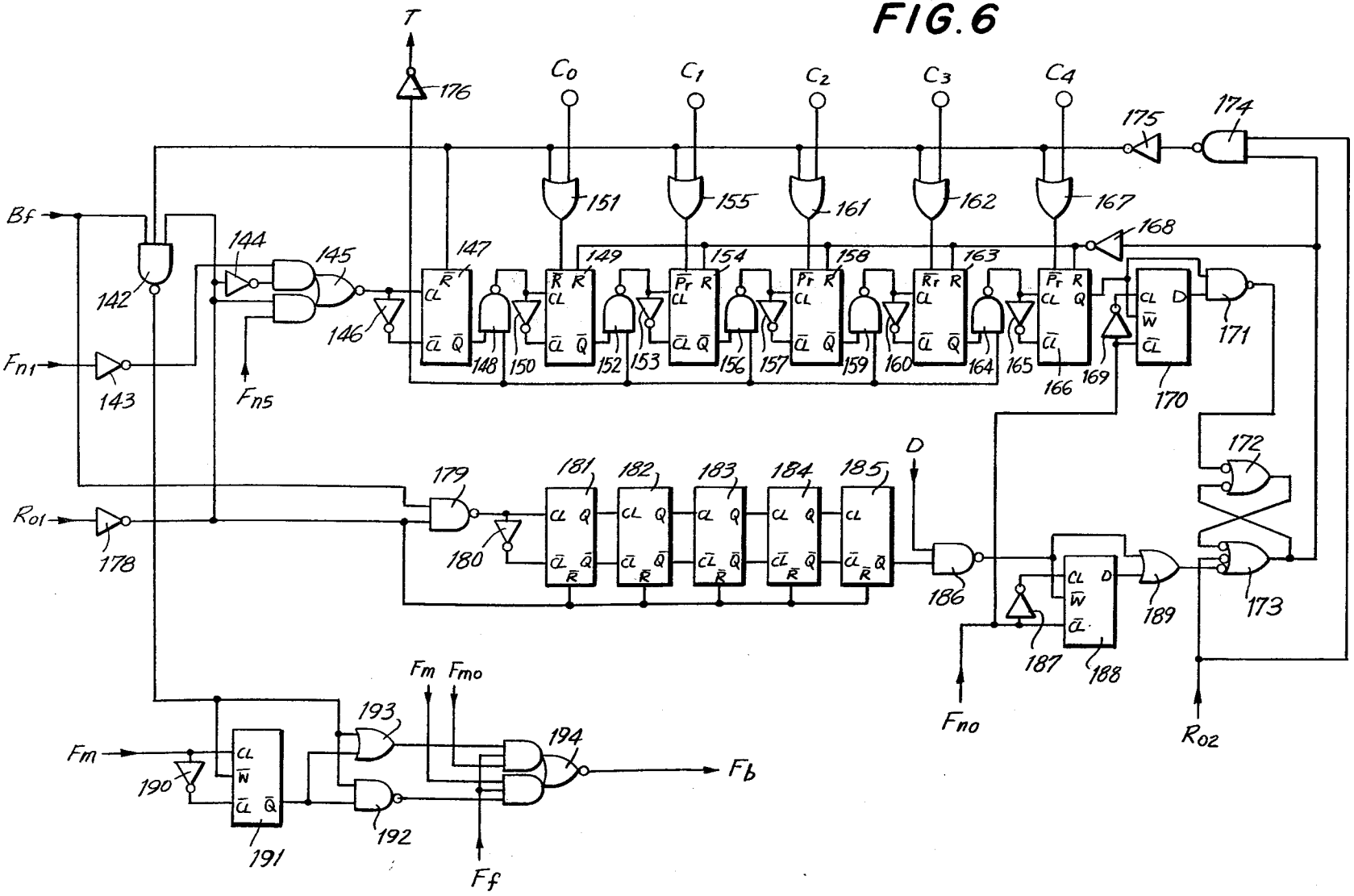

In FIG. 6, the terminals $C_0$, $C_1$, $C_2$, $C_3$ and $C_4$ carry preset signals for determining the amount of adjustment to be applied to the signals in the divider network received from the oscillator circuit 102. The amount of adjustment is dependent upon the frequency difference signal Bf. Thirty-two different adjustments can be formed by applying combinations of high and low signals at each of these five terminals.

First, these circuits are explained in the normal mode where the output signal $R_{01}$ of the resetting circuit 117 is low and the output $R_{02}$ of the resetting circuit 117 is high. That is, the external member is not operated.

As the output $R_{01}$ is low and the output $R_{02}$ is high, the frequency difference signal Bf is applied to a circuit 194 comprised of two AND circuits feeding a NOR circuit through a NAND gate 142. The output signal Fb from the circuit 194 is a signal which is obtained by adding the frequency difference signal Bf to signals Fm and $Fm_0$ from the divider stage 113 operating on the signals of the oscillator 102. As explained hereinafter, the output signals of presettable counters are applied to the NAND circuit 142. The output signals of the presettable counters are determined by the preset signals on the aforementioned terminals $C_0$–$C_4$. In particular, when the output of a NAND circuit 171 goes low, the output of the flip-flop comprised of OR gates 172, 173 having inverted inputs, goes low, and this low signal is applied to the NAND gate 142 through the NAND gate 174 and inverter 175. As a result, the difference signal Bf is not passed through the gate 142 and is not added to the divider signals Fm and $Fm_0$. Thus, only the divider signals Fm and $Fm_0$ derived from the oscillator 102 appear at the output Fb of the circuit 194.

Additionally, the frequency difference signal Bf is transmitted to a NAND gate 179 and is divided by five stages of counters, each of which comprises a flip 181–185 respectively. The output of the five divider stages is transmitted to the aforementioned latch including the gates 172, 173 to set that circuit so that a high output is produced from the inverter 175. The high output from the inverter 175 is applied to the NAND gate 142 and the frequency difference signal Bf passes through the gate 142 and into the output Fb.

Accordingly, it is possible to adjust the periodic timing rate by determining, using the five stages of counters 181–185, when the frequency difference Bf is to be added to the divider signals Fm and $Fm_0$ and determining the added amount of signal Bf at the periodic timings by means of presettable counters 149, 154, 158, 163, 166.

Next, the situation where signal $R_{01}$ is high, that is, the external member has been actuated. The high signal (FIG. 6) $R_{01}$ is applied after inversion by the inverter 178 to the NAND gate 142. The output of the NAND gate therefore is always high so the frequency difference signal Bf does not pass through the gate 142 and is not added to the signals from the divider stage 113 derived from the oscillator circuit 102. That is to say the output of the circuit 194 is dependent only upon the signals Fm and $Fm_0$ which are uncorrected.

It should be noted that a clock signal selecting circuit 145 comprising two AND gates and a NOR gate, passes the signal $Fn_1$ from the divider stage 132 when the input $R_{01}$ is high. When $R_{01}$ is low, the signal $Fn_5$ normally appears. Thus, the output of the presettable counters 149, 154, 158, 163, 166 has a period of 1/512 as compared to the normal time period. A signal T is derived from an inverter 176.

When a signal D, as explained hereinafter, is low and applied to a NAND circuit 186, the output of the gate 173, which together with gate 172 constitutes a latch, goes high. The presettable counters 149, etc. are preliminarily set and the output of the NAND gate 171 goes low with a period of 1/512 relative to $Fn_1$ such that the output of the latch 172, 173 is reset to low. Accordingly, the signal T having a period of 1/512 of that of the presettable counter in normal timekeeping is derived. When the pulse width of the signal, reduced to 1/512, is measured, the amount of timekeeping rate adjustment, which is determined by the presettable counters, can be known.

Figure 7:
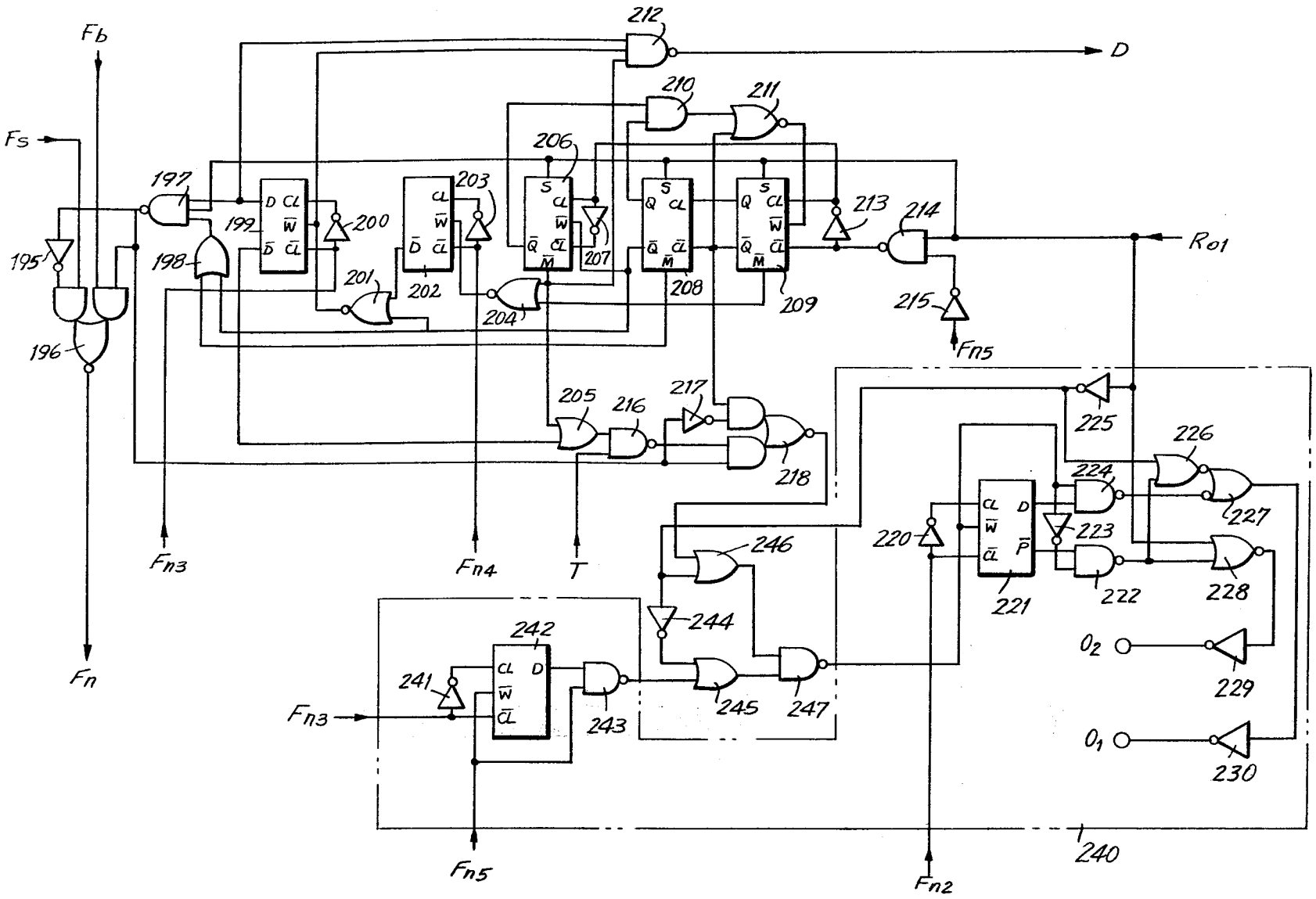

The circuit of FIG. 7 converts a reference value used for calculating the adjustment amount and thereby produces a timing adjustment signal representative of the amount of adjustment applied to the signal from the oscillator 102.

As stated above, the signal $R_{01}$ is usually low and this low signal is applied to an OR gate 245 through inverters 225, 244. At an OR gate 246, the low signal $R_{01}$ produces a high signal output. Accordingly, an output signal having a frequency of $F_{n5}$ ($\frac{1}{2}$ Hz) is applied at the terminals $O_1$ and $O_2$ after being transmitted through gates 243, 245, 247 and a flip-flop 242. Through the operation of a flip-flop 221, signals having a frequency of $\frac{1}{2}$ Hz and a pulse width of 7.8 milliseconds appear at the terminals $O_2$ and $O_1$. These $\frac{1}{2}$ Hz signals pass through the NAND circuits 222, 224 and the inverter 223. Accordingly, the signals $O_1$, $O_2$ are one second out of phase and of opposite polarity. These signals are applied to both terminals of the driving coil of a step motor to drive it and thereby cause an analog display of time using hands in the known manner. Such signals are illustrated in FIGS. 1, 2 in the drivers 6, 19 respectively.

As previously stated, when the external stem is not actuated a low signal $R_{01}$ is produced. When this low signal is applied to a NAND gate 197 the output of gate 197 goes high and the signal Fb appears at the output Fn of a circuit 196 for selecting between a divided down signal Fs from the oscillator 101, and the signal Fb which is obtained, as described above by adding the divided signals from the oscillator 2 to the frequency difference signal Bf. This signal Fn is applied to the divider stage 128 and then the signal $Fn_5$ appears at the output of the last divider stage 141, (FIG. 5). Because the signal $Fn_5$ is a divider output signal obtained after adjusting the timing rate of the oscillator 102, the signal $Fn_5$ is accurate independent of temperature changes.

Next, the condition of resetting is explained. When the signal $R_{01}$ is high, that is, when the external member is actuated, the output of the NOR gate 228 goes low and the signal at the output $O_2$ becomes high after passing through the inverter 229. The output of the inverter 229 remains high so long as the signal $R_{01}$ is high. At the same time the output of the OR gate 245 goes high by means of the inverters 225, 244, and a low signal is applied to the OR gate 246, such that the output of a NOR gate 218, to which the signal T is applied through the NAND gate 216, appears at the output of the NAND circuit 247 after passing through the OR gate 246. This output signal appears at the terminal $O_1$ as the coded signal representing the periodic signal of the oscillator 2 and the preselected amount of timing adjustment which is applicable at a given temperature or, expressed in other words, for a particular difference in frequency between the oscillators 101, 102.

Figure 8:
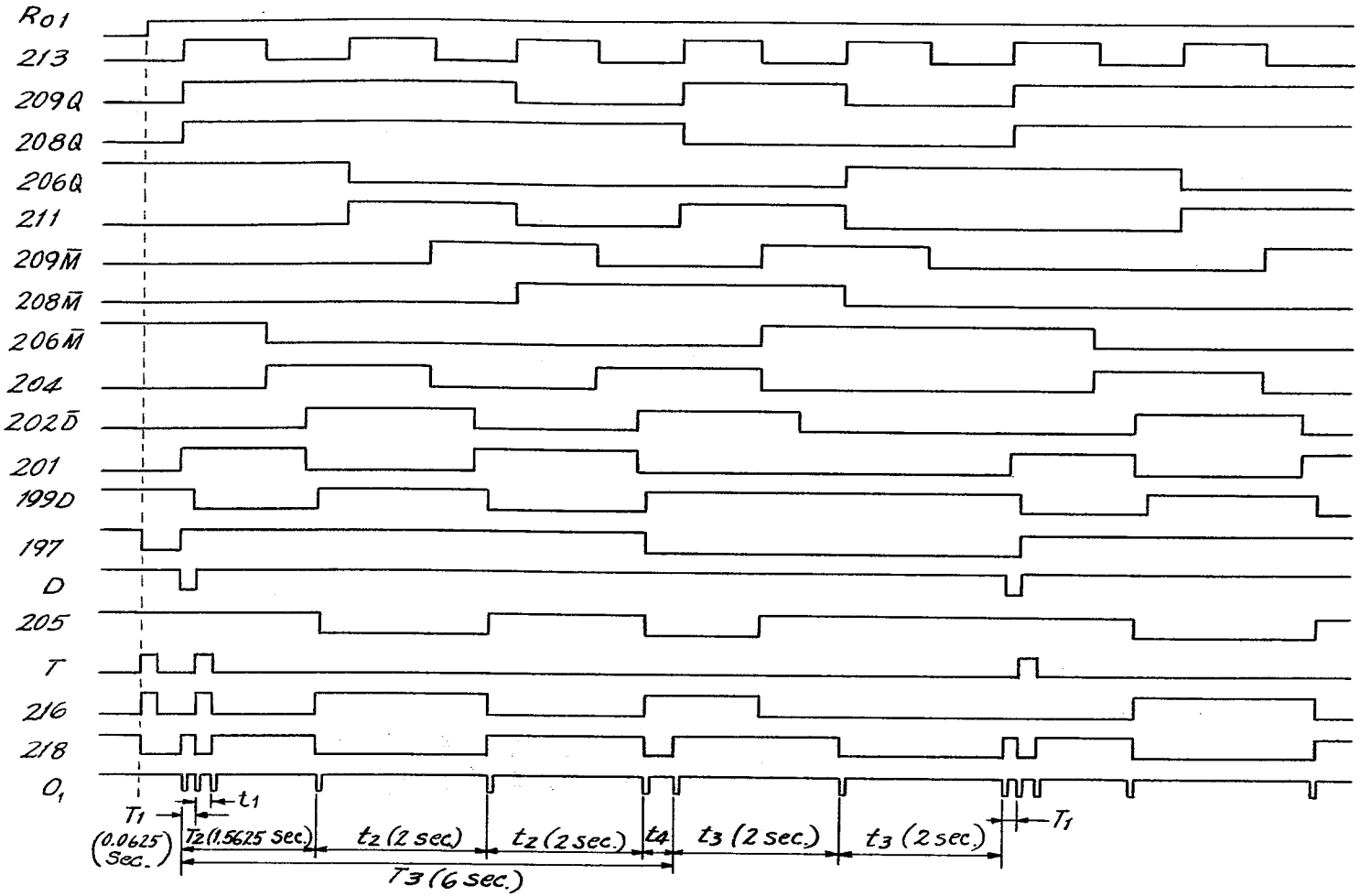
FIG. 8 shows timing waveforms associated with the circuits of FIG. 7.

When the signal $R_{01}$ is high, the set inputs S of the flip-flops 206, 208 and 209 are high to set the flip-flops, and the divided signal $Fn_5$ is applied as a clock signal through an inverter 215 and NAND gate 214 to the flip-flop 209 and the flip-flop 206. These flip-flops 206, 208, 209. And gate 210 and NOR gate 211 constitutes a quinary counter. The waveform charts of FIG. 8 shows circuit outputs. When the signal $R_{01}$ is high, the output signal D of flip-flop 199 and the output signal from the OR gate 198 are applied to the NAND 197. As a result, the output of the NAND gate 197 is high during a period of $T_2+Tt_2$. The output of the NAND gate 197 is low during a period of $T_1+2t_3+t_4$. Thus, when the output of the NAND gate 197 is high, the signal Fb, which is a divided uncorrected signal from the oscillator 102, appears at the output of the NOR gate 196. On the other hand, when the output of the NAND gate 197 is low, the signal Fs, which is a divided signal output from the oscillator 101, appears at the output of the NOR gate 196.

The output signal $\overline{M}$ from flip-flop 206, the output signal of the NOR gate 201, and the output signal at the D terminal of the flip-flop 199 are applied to a NAND gate 212. At the output of the NAND gate 212 a timing signal D is produced for application to the NAND gate 186 (FIG. 6) for producing, in conjunction with the presettable counters 149, 154, 158, 163, 166 a preselected period of time having a period of $T_3+2t_3$. In FIG. 8 this period is shown as ten seconds. This preselected value is presented at the terminal $O_1$, after passing through the OR gate 205, NAND gate 216 and circuits 218, as a periodic signal having a period of $t_1$. The period $t_1$ can be, for example, the reciprocal of the preselected time value of ten seconds, that is, $t_1$ can be presented as 0.1 seconds or the 1/512 period signal T can be presented.

The output signal $\overline{D}$ from the flip-flop 199 appears at the terminal $O_1$, after passing through the OR gate 205, NAND gate 216 and circuit 218, as a periodic signal having a period $t_2$ which is the timing rate signal from the oscillator 102. Further, the output signal $\overline{Q}$ of the flip-flop 209 appears that the terminal $O_1$ after passing through the circuits 218 as a periodic signal having a period $t_3$ which is the timing rate from the oscillator 101. In other words, after the times $T_1$, $T_2$ and $T_3$, pulse signals appear at the terminal $O_1$ of the pulse motor having periods of $t_1$, $t_2$, and $t_3$ respectively. Thus, as shown in the waveform of FIG. 8, when the circuit is actuated by operation of the external member such that the signal $R_{01}$ goes high, the preselected value of time incorporated in the presettable counters by means of signals applied at the terminals $C_0$–$C_4$ is represented by a signal having a period $t_1$. This is not the actual time cycle of the presettable counters but is a coded representation, as stated above, for examples, a reciprocal or 1/512 of the period. The period of the timing signal for driving the pulse motor as would be provided without correction is indicated by pulses having a period $t_2$. A divided down signal from the oscillator 101 is provided having a period $t_3$. These signals which are applied to the coil of the pulse motor are of insufficient pulse width to drive the motor, but these signals in the motor windings can be readily detected by external electromagnetic detection means.

As stated previously, in normal operation, the timing rate signals from the oscillator 102 appear at the motor terminals $O_1$ and $O_2$ after being corrected. However, when the external member is actuated so that the timing accuracy of the timepiece can be reset, the coded signal representing the preselected time values associated with the presettable counters, and the uncorrected divided signals of the oscillators 101, 102 cyclically appear only at the output $O_1$. The signals by which the operation accuracy of the oscillators, and the adjustments made thereto can be determined are provided by means of the converter circuits. Such a converter circuit is shown with the reference numeral 20 in FIG. 2 where two quartz crystal vibrators are used. A similar converter circuit construction as described above can also be applied to a timepiece construction as shown in FIG. 1 wherein only one quartz crystal vibrator is utilized and the $O_1$signal has only two components.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic wristwatch including a first oscillator means for outputting a high frequency time standard signal having a timing rate, first divider means for receiving said high frequency time standard signal and producing a low frequency timekeeping signal, adjustment means coupled to said first divider means for effecting a predetermined adjustment of the frequency of said low frequency timekeeping signal produced by said first divider means by varying the division ratio of said first divider means, said adjustment means including a plurality of switches, said dividing ratio of said first divider means being subject to selective variation by selective setting of said plural switches, and driving means and display means adapted to provide a display of time in response to said low frequency timekeeping signal being applied thereto, the improvement therein comprising converter means for producing a timing rate adjustment measurement signal, said measurement signal including a first component and second component, said first component being at least representative of the predetermined amount of adjustment included in the frequency of said low frequency timekeeping signal to provide accuracy in timekeeping, and further coding said selected setting of said plurality of switches of said adjustment means in accordance with the period of said predetermined adjustment, said second component of said ajustment signal being said timing rate signal divided by said first divider means without operation of said adjustment means, said first component and said second component generating alternately and continuously with periodicity, said converter means being adapted to operate in response to at least said low frequency timekeeping signal being applied thereto; and further comprising coil means whereto said timing rate adjustment measurement signal is applied, said coil means generating externally detectable signals in response to said measurement signal.

2. An electronic wristwatch as claimed in claim 1, and including selector means adapted to be disposed in a first timekeeping mode and in a second timing rate adjustment measurement mode, said selector means being adapted to receive said low frequency timekeeping signal in said first mode and to transmit said timekeeping signal to said driving and display means, said selector circuit being further adapted in said second mode to transmit said low frequency timekeeping signal to said converter circuit, whereby said time rate adjustment measurement signal is produced.

3. An electronic wristwatch as claimed in claim 2, wherein said selector means includes a manually displaceable resilient switch and a selector circuit, said resilient switch being disposed in one of a first and second position, said selector circuit being disposed in said first mode for transmitting said low frequency timekeeping signal when said selector spring is in said first position, and in said second mode when said selector spring is disposed in said second position.

4. An electronic wristwatch as claimed in claim 3, and including a manually operative stem adapted to be displaced between a first position and a second position, said manually operative stem being operably coupled to said resilient switch for disposing said switch into said first position when said manually operative stem is disposed in said first position, said manually operative stem being disposed out of contact with said resilient switch for disposing same into said second position when said manually operative stem is in said second position.

5. An electronic wristwatch as claimed in claim 1, wherein said converter circuit is adapted to output said adjustment measurement signal to said driving means and said display means, said coil means being a portion of said driving and display means.

6. An electronic wristwatch as claimed in claim 5, wherein said adjustment measurement signals have a pulse width insufficient to drive said display means.

7. An electronic wristwatch as claimed in claim 6, wherein said display means include said coil means.

8. An electronic wristwatch as claimed in claim 7, wherein said coil electromagnetic means is a portion of a pulse motor.

9. An electronic wristwatch as claimed in claim 1, and further comprising:

second oscillator means for outputting a secondary high frequency time standard signal and second divider means for receiving said secondary high frequency time standard signal and in response thereto producing a secondary lower frequency signal;

comparator means adapted to receive a frequency signal produced by said first divider means and said secondary lower frequency signal produced by said second divider means, for producing a comparator output signal representative of the difference therebetween, said comparator means being adapted to apply an adjustment signal to said adjustment means coupled to said first divider means for adjusting the timing rate of said low frequency timekeeping signal produced thereby.

10. An electronic wristwatch as claimed in claim 9, wherein said adjustment measurement signal includes a third component, said third component being representative of the frequency of said secondary high frequency time standard signal.

11. An electronic wristwatch as claimed in claim 10, wherein said converter circuit is adapted to output said adjustment measurement signal to said driving means and said display means.

12. An electronic wristwatch as claimed in claim 10, wherein said first signal component represents said predetermined amount of adjustment by the time period of said signals of said first component, said second signal component includes a first low frequency timekeeping portion representative of the timing rate of said first oscillator means, and said third signal component includes a second low frequency timekeeping portion representative of the timing rate of said second oscillator means.

13. An electronic wristwatch as claimed in claim 12, wherein said adjustment measurement signal is periodic and said signal components are cylically produced in sequence.

14. An electronic wristwatch as claimed in claim 9, and further comprising means for inputting said low frequency signal from said second divider means into a portion of said first divider means, whereby said second low frequency timekeeping portion of said adjustment measurement signal is produced at the output of said first divider means.

15. An electronic wristwatch as claimed in claim 14, wherein said converter circuit is adpated to output said adjustment measurement signal to said driving means and said display means.

16. An electronic wristwatch as claimed in claim 12, wherein said converter circuit is adapted to output said adjustment measurement signal to said driving means and said display means.

* * * * *